US010787901B2

(12) United States Patent
Karale

(10) Patent No.: US 10,787,901 B2
(45) Date of Patent: Sep. 29, 2020

(54) DYNAMICALLY OPTIMIZING A PUMPING SCHEDULE FOR STIMULATING A WELL

(71) Applicant: Halliburton Energy Services, Inc., Houston, TX (US)

(72) Inventor: Chaitanya Karale, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 97 days.

(21) Appl. No.: 16/324,052

(22) PCT Filed: Sep. 16, 2016

(86) PCT No.: PCT/US2016/052172
§ 371 (c)(1),
(2) Date: Feb. 7, 2019

(87) PCT Pub. No.: WO2018/052438
PCT Pub. Date: Mar. 22, 2018

(65) Prior Publication Data

US 2020/0190975 A1 Jun. 18, 2020

(51) Int. Cl.
*E21B 49/00* (2006.01)
*E21B 43/26* (2006.01)

(52) U.S. Cl.
CPC ..... *E21B 49/00* (2013.01); *E21B 43/26* (2013.01)

(58) Field of Classification Search
None
See application file for complete search history.

(56) References Cited

U.S. PATENT DOCUMENTS 6,196,318 B1 3/2001 Gong et al.
6,668,922 B2 12/2003 Ziauddin et al.
(Continued)

FOREIGN PATENT DOCUMENTS

EP 1381754 1/2004
WO 2006018778 2/2006
(Continued)

OTHER PUBLICATIONS

Ahmed et al., "An Innovative Approach to Forecasting Matrix Stimulation Treatment Results: A Case Study", Society of Petroleum Engineers, 2014, 11 pages.
(Continued)

*Primary Examiner* — Shane Bomar
(74) *Attorney, Agent, or Firm* — Kilpatrick Townsend & Stockton LLP

(57) ABSTRACT

A pumping schedule for stimulating a well can be dynamically optimized. For example, a layer in a well can be determined to have a highest value for a characteristic. The layer can be assigned as a first layer in an ordered list. A pump rate and type of fluid to pump into the wellbore for reducing an amount of blockage to below a threshold value can be determined based on a feature of the first layer. The blockage can reduce a flow of a production fluid from the first layer into the wellbore. Changes to values for the characteristics of layers in the well resulting from pumping the fluid can be determined. Another layer in the well can be determined to have the highest value for the characteristic as a result of pumping the fluid into the wellbore and can be assigned as the first layer in the ordered list.

20 Claims, 6 Drawing Sheets

(56) References Cited

U.S. PATENT DOCUMENTS

| | | | | |
|---|---|---|---|---|
| 7,318,475 | B2 | 1/2008 | Cavazzoli et al. | |
| 8,016,034 | B2 | 9/2011 | Glasbergen et al. | |
| 9,228,425 | B2 | 1/2016 | Ganguly et al. | |
| 2005/0115711 | A1 | 6/2005 | Williams et al. | |
| 2006/0000609 | A1 | 1/2006 | Cavazzoli | |
| 2006/0278389 | A1 | 12/2006 | Ayoub et al. | |
| 2007/0294034 | A1 | 12/2007 | Bratton et al. | |
| 2008/0015832 | A1 | 1/2008 | Tardy | |
| 2011/0247824 | A1 | 10/2011 | Gu | |
| 2014/0006992 | A1* | 1/2014 | Broussard, III | G06F 3/0481 715/771 |
| 2014/0182841 | A1 | 7/2014 | Lecerf et al. | |
| 2015/0159079 | A1 | 6/2015 | Huh et al. | |
| 2016/0251948 | A1 | 9/2016 | Weng et al. | |
| 2016/0253767 | A1* | 9/2016 | Langenwalter | E21B 41/0092 705/7.38 |
| 2017/0152728 | A1* | 6/2017 | Abou-Sayed | E21B 47/00 |
| 2018/0230782 | A1* | 8/2018 | Pankaj | G01V 1/288 |
| 2019/0024495 | A1* | 1/2019 | Wise | E21B 41/0092 |
| 2019/0242233 | A1* | 8/2019 | Le Calvez | E21B 43/267 |
| 2019/0345808 | A1* | 11/2019 | Suryadi | E21B 7/067 |

FOREIGN PATENT DOCUMENTS

| | | |
|---|---|---|
| WO | 2012087864 | 6/2012 |
| WO | 2014105451 | 7/2014 |
| WO | 2016164056 | 10/2016 |
| WO | 2017086906 | 5/2017 |

OTHER PUBLICATIONS

Glasbergen et al., "Improved Acid Diversion Design Using a Placement Simulator", Society of Petroleum Engineers, 2006, 11 pages.

Glasbergen et al., "The Optimum Injection Rate for Wormhole Propagation: Myth or Reality", Society of Petroleum Engineers, 16 pages, 2009.

Jones et al., "Quantifying acid placement: The key to understanding damage removal in horizontal wells", Society of Petroleum Engineers Inc., 1996, 15 pages.

International Patent Application No. PCT/US2016/052172 , "International Search Report and Written Opinion", Jul. 5, 2017, 10 pages.

Petrowiki , "Acid placement and coverage", Retrieved from the internet at http://petrowiki.org/Acid_placement_and_coverage#cite_note-r12-11, May 11, 2016, 5 pages.

Ramondenc , "Achieving Optimum Placement of Stimulating Fluids in Multilayered Carbonate Reservoirs: A Novel Approach", Society of Petroleum Engineers, SPE 166184, 2013, 11 pages.

* cited by examiner

DYNAMICALLY OPTIMIZING A PUMPING SCHEDULE FOR STIMULATING A WELL

TECHNICAL FIELD

The present disclosure relates generally to stimulating a well, and more particularly (although not necessarily exclusively), to dynamically optimizing a pumping schedule for stimulating the well.

BACKGROUND

A well system, such as an oil or gas well for extracting hydrocarbon fluids from a subterranean formation, can develop blockage in one or more layers. The layers can be portions of a subterranean formation through which a wellbore is formed that are adjacent the wellbore. Each layer can have a different permeability and a different amount of blockage that affect the rate that production fluid flows from the subterranean formation into the wellbore. The well can be stimulated using acidizing treatments to improve the rate of production fluid entering the wellbore. Acidizing treatments can include pumping fluid at specific pump rates into the wellbore to improve the permeability of the layers. In some wellbores (e.g., wellbores in carbonate formations), an acid pumped at a high pump rate can create channels through the layers for bypassing the blockage. In additional or alternative wellbores (e.g., wellbores in sandstone formations), an acid pumped at a low pump rate can cause the radius of the wellbore to be increased by compact dissolution of the formation.

DETAILED DESCRIPTION

Figure 1:
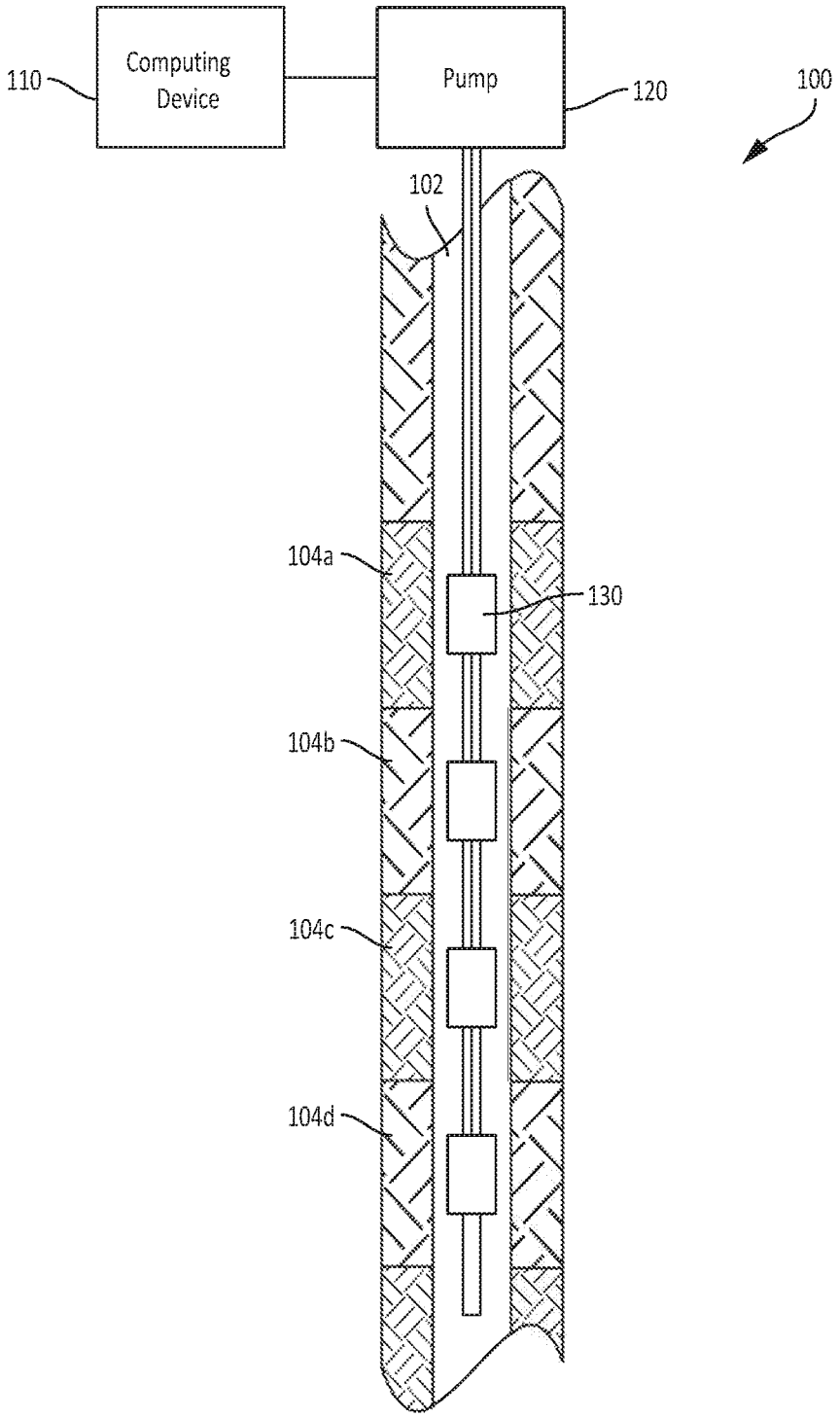
FIG. 1 is a partial cross-sectional diagram of an example of a well having a wellbore and a system for reducing an amount of blockage in layers of a subterranean formation according to one aspect of the present disclosure.

Certain aspects and features relate to dynamically adjusting a pumping schedule for stimulating a well. The pumping schedule can include a schedule for pumping different fluids at different pump rates into a wellbore. The wellbore can pass through a subterranean formation, and the fluid can be pumped into the wellbore to reduce an amount of blockage in a layer of the subterranean formation. As fluid is pumped into the wellbore according to the pumping schedule, characteristics of one or more layers of the subterranean formation can change. An example of a characteristic can include a permeability, a leak-off rate, or a leak-off rate per unit height of the surrounding subterranean formation. The pumping schedule can be dynamically adjusted (e.g., the type of fluid and the pump rate of the fluid can be modified) to account for changes to the characteristics of the one or more layers resulting from pumping the fluid into the wellbore. By dynamically adjusting the pumping schedule to account for these changes, a more accurate pumping schedule can be determined.

In some examples, the type of fluid and the pump rate are based on features of the layer having a highest value for the characteristic. The values for the characteristics of the layers can change as the fluid is pumped into the wellbore and can alter which layer has the highest value for the characteristic. The type of fluid and the pump rate can be adjusted based on the changes to the values for the characteristics of the layers. In additional or alternative examples, the type of fluid and the pump rate are based on an ordered list of the layers. The ordered list can be sorted from a layer having a highest value for the characteristic to another layer having a lowest value for the characteristic. The ordered list can be adjusted based on changes to the values for the characteristics of each layer resulting from pumping the fluid.

The wellbore can pass through the subterranean formation. The layers can be portions of the subterranean formation adjacent to the wellbore. In some examples, Production fluid can pass through the layers into the wellbore based on the value for the characteristic of each layer. In additional or alternative examples, stimulation fluid can pass through the wellbore into the layers based on the characteristics of each layer. The value for the characteristic can include a permeability of the layer, a leak-off rate of the layer, or a leak-off rate per unit height of the layer or a leak-off rate per unit measured depth of the layer. The permeability of a layer can include an ability of fluid to traverse through the layer. The leak-off rate of a layer can include an amount of the fluid that is being received by the layer. In some examples, the leak-off rate can be affected by the depth of the layer, as less fluid may reach a layer deeper in the wellbore. The leak-off rate per unit height of the layer can include an amount of the fluid that is being received by the layer in relation to the height of the layer. In some examples, the leak-off rate per unit height of the layer can be used to normalize the leak-off rate of different layers of a subterranean formation having different surface areas. In additional or alternative examples, the leak-off rate per unit height can include an amount of the fluid that is being received by the layer in relation to a length of the layer.

In some aspects, the term "blockage" can include anything that restricts fluid flow from the subterranean formation into the wellbore. Blockage can be formed by the subterranean formation itself, damage resulting from drilling operations or other operations, or any combination of these. The amount of blockage, which can also be referred to as skin, can be a positive value or a negative value. A positive value can indicate a reduction in a value for the characteristic of the layer. A negative value can indicate an increase in the value for the characteristic of the layer.

An acidizing process can include pumping a series of different fluids at different pump rates into the wellbore to reduce the amount of blockage at each layer to below a threshold value. A pumping schedule for the acidizing process can be dynamically optimized by adjusting the type and pump rate of the fluids pumped into the wellbore based on features of the first layer in the ordered list of the layers.

The first layer can be the layer with the highest value for the characteristic (e.g., the highest permeability, highest leak-off rate, highest leak-off rate per unit height). Features of the layers, including which layer has the highest value for the characteristic, can change as a result of the fluids pumped into the wellbore. For example, the first layer (e.g., the layer having the highest value for the characteristic) can be deeper in a wellbore than another layer (e.g., the layer having the second highest value for the characteristic layer) and the fluids pumped into the wellbore can reach the other layer before the first layer. The fluids can stimulate the other layer before reaching the first layer and result in the other layer developing a higher value for the characteristic than the first layer. The ordered list of the layers can be adjusted such that the other layer becomes the first layer in the ordered list. The pumping schedule can be optimized by adjusting the type and pump rate of the fluids pumped into the wellbore based on the features of the new first layer targeted or prioritized for stimulation.

In some aspects, a computing device can perform a simulation of the pumping schedule on a simulated wellbore and generate a dynamically optimized pumping schedule. The dynamically optimized pumping schedule can be used as part of an actual acidizing process to stimulate the well by increasing the value for the characteristic of each layer in a subterranean formation. In additional or alternative aspects, a system including a computing device, a pump, and sensors can dynamically optimize the pumping schedule in real time (e.g., substantially contemporaneously) with the acidizing process being performed.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a partial cross-sectional diagram of a well 100 having layers 104*a-d* in production zone. The layers 104*a-d* can be adjacent portions of a subterranean formation through which a wellbore 102 is formed. The layers 104*a-d* can each have a different composition and a different amount of blockage therein resulting in different permeabilities. The well 100 can also include a computing device 110, a pump 120, and sensors 130.

The computing device 110 can dynamically optimize a pumping schedule for stimulating the well 100. In some aspects, the computing device 110 can use information about the wellbore 102 to simulate pumping a specific fluid (e.g., any acid) at a specific pump rate into the wellbore 102 and calculate the effects of the fluid on the characteristics of the layers 104*a-d*. The computing device 110 can determine the specific type and the specific pump rate of a fluid to pump into the wellbore 102 based on features of a layer with the highest permeability. The computing device 110 can determine that the layer with the highest permeability will change as a result of pumping a certain amount of fluid into the wellbore 102. The computing device 110 can take into account the changes in the layer with the highest permeability along with changes in permeability of other layers and record simulation data describing a series of fluids and pump rates that would reduce an amount of blockage in each layer 104*a-d* to blow a threshold value. The computing device 110 can generate a pumping schedule based on the simulation data.

In some examples, the computing device 110 can determine the type of fluid to be a diverter. A diverter can be a fluid (e.g., polylactic acid) for temporarily reducing permeability in a layer. The layer with the highest permeability can receive more of the diverter than the other layers 104*a-d*. The permeabilities of layers 104*a-d* can increase in comparison to the permeability of the layer with the highest permeability as a result of pumping the diverter. The change in permeabilities in comparison to the highest permeability can result in the other layers 104*a-d* receiving a greater portion of fluid that is subsequently pumped into the wellbore 102. For example, a layer 104*a* can be determined to have the highest permeability. As a result of pumping diverter, the permeability of the layer 104*a* can fall dramatically while the permeability of the other layers 104*b-d* may fall slightly. Since the difference between the highest permeability and the lowest permeability shrinks, the amount of subsequent fluid (e.g., treatment fluid after the diverter fluid) received by the other layers 104*b-d* in comparison to the amount of subsequent fluid received by the layer 104*a* can increase. In additional or alternative examples, the computing device 110 can determine the type of fluid to be an acid for removing or bypassing blockage to improve the permeabilities in layers 104*a-d*.

In some examples, the computing device 110 can optimize the pumping schedule so that less fluid is needed to achieve a greater stimulation of the wellbore 102. In additional or alternative examples, the computing device 110 can optimize the pumping schedule so that less time is needed to reduce blockage below a threshold value in all the layers 104*a-d*.

In some aspects, the computing device 110 can cause the pump 120 to pump a series of fluids into the wellbore 102 at varying pump rates. The pump 120 can be positioned at the surface of the well 100 for pumping a fluid into the wellbore 102. The pump 120 can be communicatively coupled to the computing device 110 for receiving instructions from the computing device 110. The instructions can indicate the type of fluid and pump rate of the fluid to be pumped into the wellbore 102. In some aspects, the pump 120 can pump different acids and diverters into the wellbore 102 at different pump rates. In additional or alternative aspects, the well 100 can include one or more pumps. Each of the pumps can pump different types of fluid at different pump rates.

The sensors 130 can be positioned in the wellbore 102 for measuring a permeability of each layer. In some aspects, the sensors 130 can measure the permeability of each layer 104*a-d* by measuring an amount of fluid that flows into each layer 104*a-d*. The sensors 130 can measure an amount of the fluid entering a portion of the wellbore 102 adjacent to a specific layer and an amount of the fluid exiting the portion of the wellbore 102 adjacent to the specific layer. The difference between the amount entering the portion of the wellbore 102 and the amount exiting the portion of the wellbore 102 can indicate an amount of the fluid that leaked off into the specific layer. The sensors 130 can be communicatively coupled to the computing device 110 for transmitting sensor data (e.g., the amounts of fluid entering and exiting each layer 104*a-d*) indicating the permeabilities of the layers 104*a-d* to the computing device 110.

Although FIG. 1 depicts the wellbore 102 as passing through four layers 104*a-d*, a wellbore can pass through any number of layers. The layers can differ in features including depth, composition, and shape. The well 100 can include a multilateral wellbore having any number of lateral bores, each passing through any number of layers. In some examples, the wellbore can include a cement casing. The wellbore can be in any phase, including installation, completion, stimulation, and production. In some aspects, a wellbore can have a single sensor. In additional or alternative aspects, one or more of the sensors can determine permeability for more than one layer. In additional or alternative aspects, the sensors can be used for measuring features of the wellbore and the layers. Information on the features can be transmitted to a computing device to improve the accuracy of calculations performed by the computing device as part of a simulation of an acidizing process.

Although the above examples are described in terms of the permeabilities of the layers 104*a-d*, other examples can be implemented using any number and combination of values for the characteristics of the layers 104*a-d*. For example, the computing device 110 can use information about the wellbore 102 to simulate pumping a specific fluid at a specific pump rate into the wellbore 102 and calculate the effects of the fluid on the leak-off rates of the layers 104*a-d*. The computing device 110 can determine the specific type and the specific pump rate of a fluid to pump into the wellbore 102 based on features of a layer with the highest leak-off rate.

Figure 2:
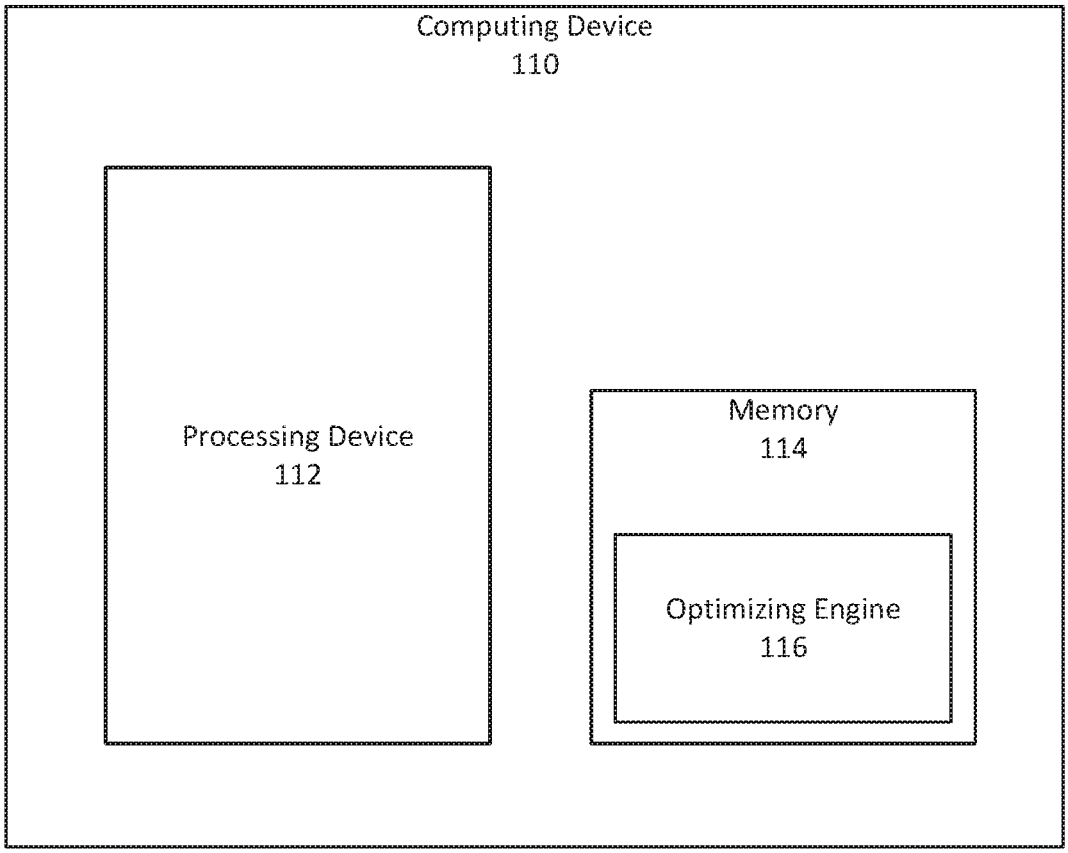
FIG. 2 is a block diagram of an example of a computing device for dynamically optimizing a pumping schedule for stimulating a well according to one aspect of the present disclosure.

FIG. 2 is a block diagram of the computing device 110 in FIG. 1 for dynamically optimizing a pumping schedule to stimulate the wellbore 102. The computing device 110 can include a processing device 112 configured for executing program code stored in the memory 114. Examples of the processing device 112 can include a microprocessor, an application-specific integrated circuit ("ASIC"), a field-programmable gate array ("FPGA"), or other suitable processing device. In some aspects, the computing device 110 can be a dedicated computing device used for dynamically optimizing a pumping schedule for stimulating the well 100 of FIG. 1. In additional or alternative aspects, the computing device 110 can perform functions in addition to dynamically optimizing a pumping schedule for stimulating the well 100. For example, the computing device 110 can control the pump 120 for performing the pumping schedule.

The processing device 112 can include (or be communicatively coupled with) a non-transitory computer-readable memory 114. The memory 114 can include one or more memory devices that can store program instructions. The program instructions can include, for example, an optimizing engine 116 that is executable by the processing device 112 to perform certain operations described herein.

The operations can include dynamically optimizing a pumping schedule for stimulating the well 100. In some aspects, the processing device 112 can control the pump 120 and dynamically adjust the type of fluid and pump rate of the fluid pumped into the wellbore in response to receiving sensor data from sensors 130 positioned in the wellbore 102. The operations can further include instructions for causing the processing device 112 to simulate an acidizing treatment and generate a pumping schedule for reducing the amount of blockage to below a threshold value for all of the layers 104*a-d*. The processing device 112 can use information about the wellbore 102 from sensors 130 to calculate expected changes to the values for the characteristics of the layers 104*a-d* as a result of pumping a specific type of fluid at a specific pumping rate. The processing device 112 can calculate a series of pumping instructions to form the dynamically optimized pumping schedule.

Figure 3:
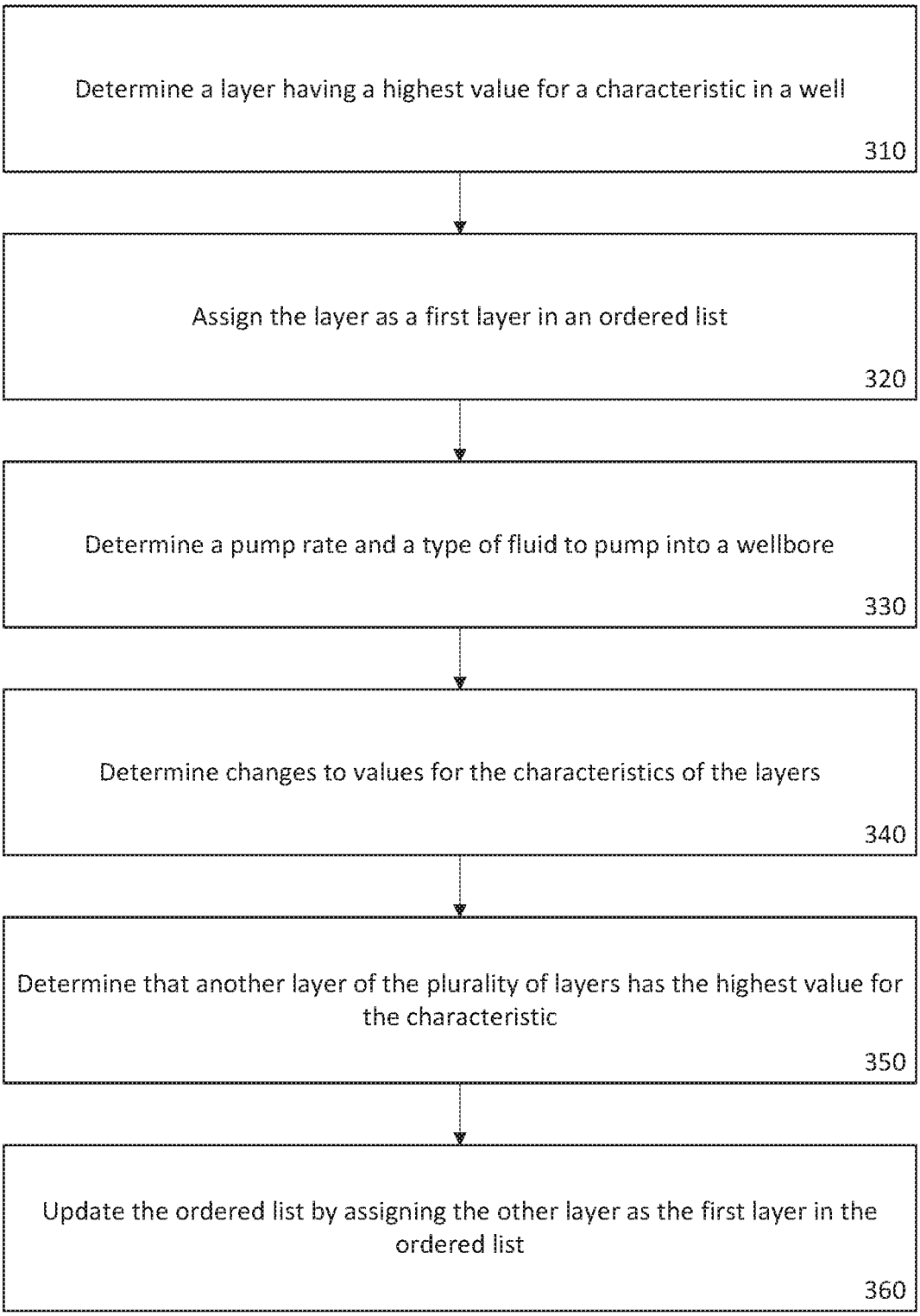
FIG. 3 is a flow chart of an example of a process for dynamically optimizing a pumping schedule for stimulating a well according to one aspect of the present disclosure.

FIG. 3 is a flow chart of an example of a process for dynamically optimizing a pumping schedule for stimulating a well. The process can be performed by the computing device 110 in FIG. 2 to stimulate well 100 in FIG. 1. In some examples, the process can include dynamically adjusting the type and pump rate of a fluid based on features of a layer having the highest permeability, highest leak-off rate, or highest leak-off rate per unit height. In additional or alternative examples, the process can include dynamically updating an ordered list of the layers for prioritizing or targeting the layer for stimulation and adjusting the type of fluid and pump rate of the fluid to be pumped into the wellbore for reducing the amount of blockage to below a threshold value in each layer.

In block 310, a layer having the highest value for the characteristic in the well 100 is determined. The layers 104*a-d* can be adjacent portions of a subterranean formation through which the wellbore 102 is formed. In some aspects, the composition of the layers can cause each layer to have a natural permeability. Blockage can build up in each layer causing the permeability of each layer to be less than the natural permeability.

In block 320, the layer can be assigned as a first layer in an ordered list of layers. Based on determining that the particular layer has the highest value of the characteristic, the processing device 112 can assign the layer as the first layer in the ordered list of the layers. All the layers 104*a-d* in the well 100 can be arranged in the ordered list from highest permeability to lowest permeability such that the first layer in the ordered list of the layers 104*a-d* has the highest permeability. In additional or alternative aspects, the ordering can be based on other characteristics, such as leak-off rate or leak-off rate per unit height. The ordered list of the layers 104*a-d* can be determined by the processing device 112 and the ordered list can be maintained in a database stored in memory 114.

In block 330, a pump rate and a type of fluid to pump into the wellbore 102 are determined. The processing device 112 can determine a pump rate and a type of a fluid to pump into the wellbore 102 for reducing an amount of the blockage in the first layer of the ordered list to below a threshold value. The pump rate and type of the fluid can be based on a feature of the first layer in the ordered list of the layers 104*a-d*. In some examples, the feature of the first layer can include the amount of blockage or the type of blockage affecting the first layer. In additional or alternative examples, the feature of the first layer can include the composition or permeability of the first layer. For example, the first layer can include carbonate and may respond to a high pump rate of acid by creating channels to bypass the blockage and increase the value for the characteristic (e.g., permeability) of the first layer. In additional or alternative examples, the first layer can include sandstone and may respond to a low pump rate of acid by dissolving the blockage and increase the value for the characteristic of the first layer.

In block 340, changes to the values for the characteristics of the layers 104*a-d* are determined. In some aspects, the processing device 112 can determine changes to permeabilities of the layers 104*a-d* resulting from pumping the type of fluid into the wellbore 102 at the pump rate. In some examples, the computing device 110 can cause the pump 120 to pump the type of fluid into the wellbore 102 at the pump rate. The fluid can stimulate one or more of the layers 104*a-d* in the wellbore 102 and change the permeabilities of the layers 104*a-d*. The computing device 110 can receive sensor data from the sensors 130 positioned in the wellbore 102 and determine (e.g., in substantially real time) changes to the permeabilities of the layers 104*a-d* based on the sensor data. In additional or alternative examples, the computing device 110 can perform a predictive simulation of the effects of pumping the type of fluid into the wellbore 102 at the pump rate by calculating the expected changes to the permeabilities. In some examples, the expected changes to the permeabilities of the layers 104*a-d* can be calculated based on previous acidizing treatments. In additional or alternative aspects, the processing device 112 can determine changes to other characteristics, such as leak-off rates or leak-off rate per unit heights of the layers 104*a-d* resulting from pumping the type of fluid into the wellbore 102 at the pump rate.

In block 350, another layer having the highest value for the characteristic, as a result of the changes to the values for the characteristics of the layers 104*a-d*, can be determined. In some aspects, the processing device 112 can determine a new layer has the highest permeability as a result of the changes to the permeabilities of the layers 104*a-d*. In some examples, a second layer in the ordered list can be closer to a surface than a first layer in the ordered list that has a higher permeability. The second layer can receive greater stimulation as a result of pumping the fluid into the wellbore 102 than the first layer. For example, a greater density of the fluid can pass the second layer than the first layer based on the fluid passing the second layer before the first layer. The second layer can develop a higher permeability than the first layer in response to the greater stimulation. In some aspects, the processing device 112 can determine the other layer has the highest leak-off rate or the highest leak-off rate per unit height as a result of the changes to the values for the characteristics of the layers 104*a-d*.

In block 360, the ordered list can be updated by assigning the other layer as the first layer in the ordered list. In some aspects, the processing device 112 can update the ordered list of the layers 104*a-d* such that the second layer is the first layer in the ordered list based on the second layer having a higher permeability or characteristic than the previous first layer. In additional or alternative aspects, the first layer may remain the first layer but other layers 104*a-d* may be rearranged in the ordered list based on the changes in permeabilities, characteristics, or features. In some aspects, the processing device 112 can updated the ordered list such that the first layer in the ordered list has the highest leak-off rate or the highest leak-off rate per unit height as a result of the changes to the values for the characteristics of the layers 104*a-d*.

Figure 4:
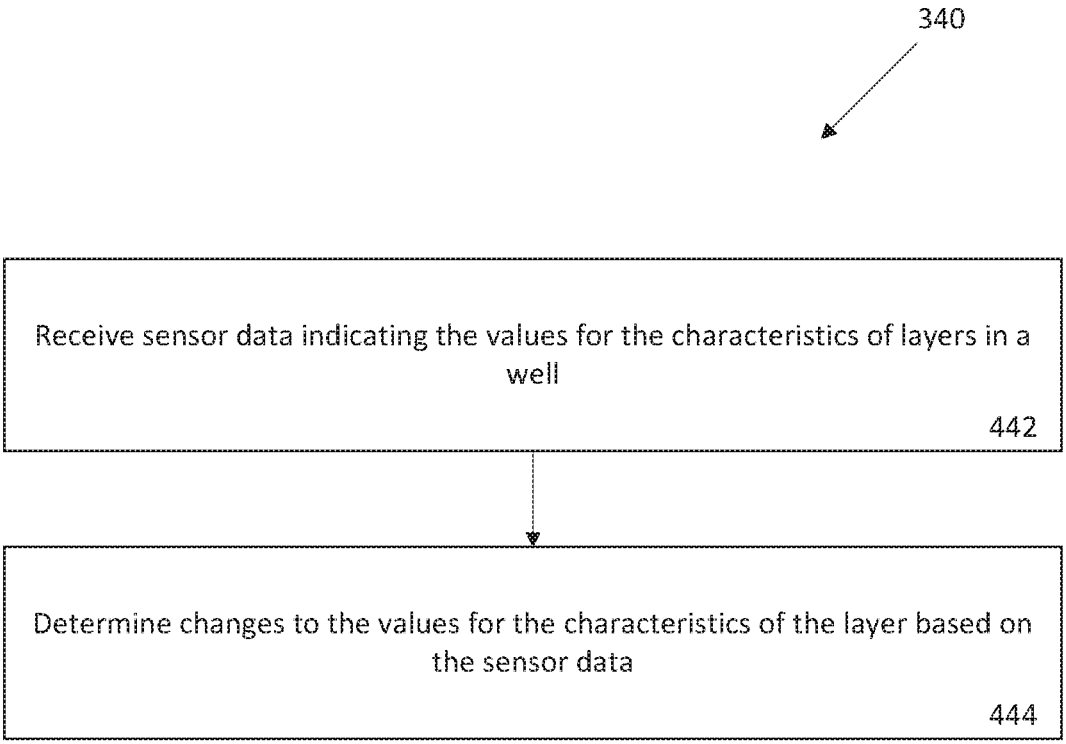
FIG. 4 is a flow chart of an example of a process for determining a change to a value for a characteristic of a layer in a well according to one aspect of the present disclosure.

FIG. 4 is a flow chart of an example of the process in block 340 of FIG. 3 for determining changes to values for the characteristics of the layers in a wellbore. In some aspects, the changes to the values for the characteristics can be determined continuously in real time as fluid is pumped into the wellbore. In additional or alternative aspects, the changes to the values for the characteristics can be determined at the end of a pumping interval, at periodic times during the pumping schedule, or after each addition of fluid downhole in a real-time simulation.

In block 442, sensor data is received indicating the values for the characteristics of layers in the wellbore. Sensor data can be information measured by sensor positioned in the wellbore. In some examples, the sensor data can include measurements of the permeability of each layer. In additional or alternative examples, the sensor data can include measurements of an amount of the fluid that leaked off into each layer. The sensors can determine the leak-off rate by comparing an amount of the fluid entering a portion of the wellbore adjacent to the layer and an amount of the fluid exiting the portion of the wellbore adjacent to the layer.

In block 444, changes to the values for the characteristics of the layers are determined based on the sensor data. A computing device can determine changes to the values for the characteristics based on analyzing the sensor data. In some examples, the computing device can compare the senor data with prior sensor data to determine change to the values for the characteristics of the layers. The computing device can also determine features of the layers from the sensor data, which can be used to determine the type and pump rate of the fluid to pump into the wellbore.

Figure 5:
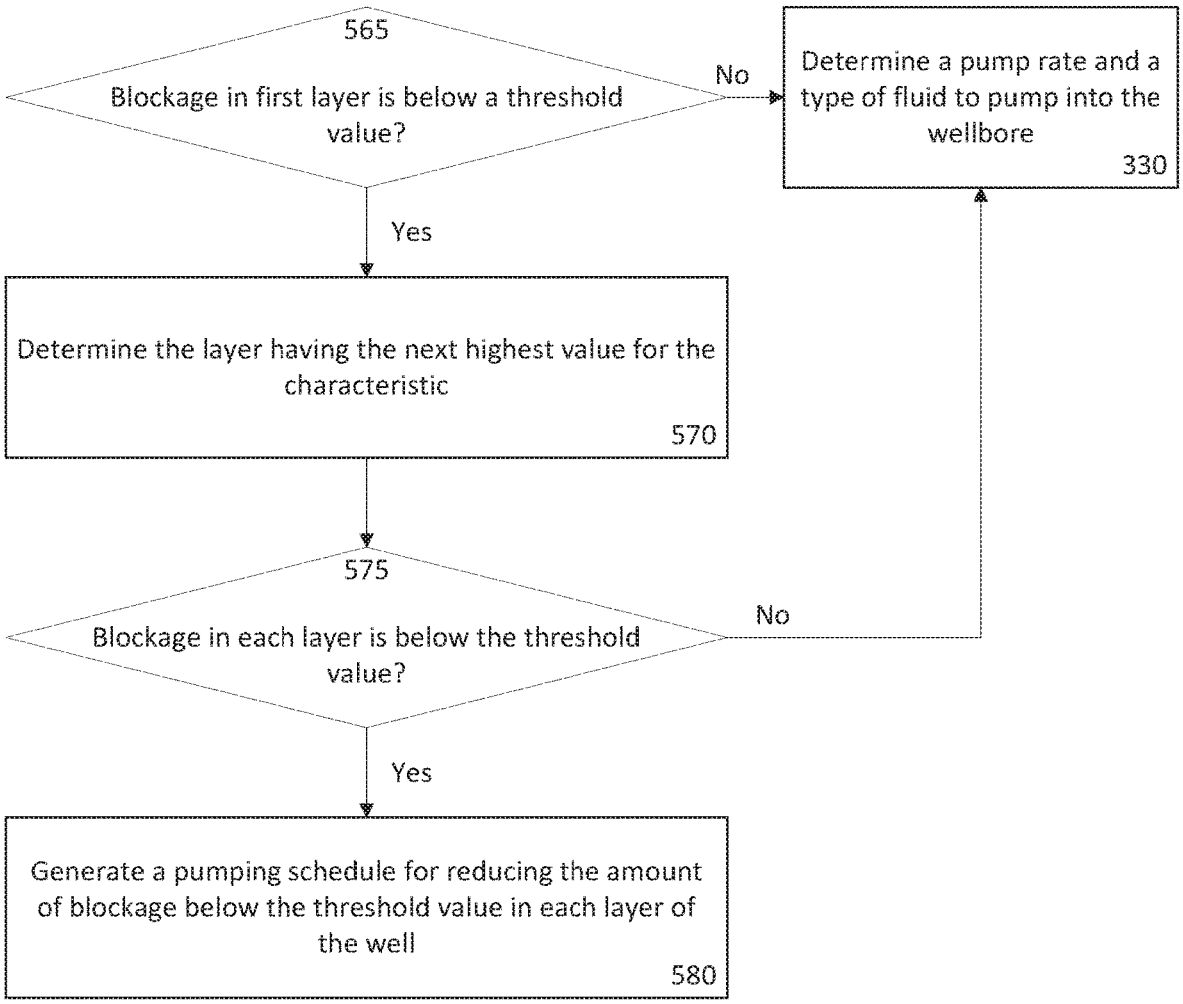
FIG. 5 is a flow chart of an example of a process for dynamically optimizing a pumping schedule for reducing an amount of blockage in each layer of a well to below a threshold value according to one aspect of the present disclosure.

FIG. 5 is a flow chart of an example of a process for dynamically optimizing a pumping schedule for reducing an amount of blockage in each layer of a wellbore to below a threshold value. The process in FIG. 5 can proceed after the process in FIG. 3 and iteratively perform a portion of the process in FIG. 3 by returning to block 330.

In block 565, during stimulation the first layer can be evaluated to determine if the amount of blockage in the first layer is below a threshold value. In some examples, the threshold value can be determined by a well operator and can be universal for all layers. In additional or alternative examples, the threshold value can be specifically assigned to the first layer and each layer can have its own specific threshold value. In some aspects, the first layer can be evaluated during diversion (e.g., a stage when the fluid is a diverter) to determine if the amount of the characteristic in the first layer is below a threshold value. For example, the characteristic of the layer can be a leak-off rate and diverter may be pumped until the leak-off rate is below the threshold value.

The pumping schedule can include pumping additional fluid into the wellbore if the blockage in the first layer is above the threshold value. For example, the process can iterate by returning to block 330 of FIG. 3. The process can determine a new pump rate and a new type of fluid can be determined. Changes to the values for the characteristics of the layers can be determined or calculated based on the results of the new pump rate and the new type of fluid. The ordered list of the layers can be updated based on the changes to the values for the characteristics of the layers. The first layer can then be reevaluated to determine if the amount of the blockage in the first layer is below the threshold value.

If the amount of blockage in the first layer is below the threshold value, the process can proceed to block 570 where the first layer in the ordered list is determined to be the layer having the next highest value for the characteristic (e.g., the next highest permeability, the next highest leak-off rate, or the next highest leak-off rate per unit height of the layer). In some examples, the first layer can be removed from the ordered list of the layers such that the layer previously listed as the second layer becomes the new first layer in the ordered list of the layers. In some aspects, the processing device can update the ordered list of the layers by removing the first layer from the ordered list of the layers, based on determining that the amount of blockage in the first layer is below the threshold value. Removing the first layer from the ordered list allows the process to determine subsequent fluid types and pump rates based on layers that have an amount of blockage above the threshold value and allows the remaining layers to be targeted one by one and complete stimulation of the well.

In block 575, one or more layers can be evaluated to determine if the amount of blockage in each layer is below the threshold value. The amount of blockage in one or more layers being above the threshold value can indicate the end conditions for the pumping schedule are not met. The process can return to block 330 of FIG. 3 and reiterate the process of determining a pump rate and type of fluid for pumping into the wellbore and determining the changes to the values for the characteristics of the layers based on the pump rate and type of fluid being pumped into the wellbore. Determining that the amount of blockage in all layers is below the threshold value can indicate that the end conditions for the pumping schedule are met.

If the amount of blockage in each layer is below the threshold value the process can proceed to block 580 where a pumping schedule for reducing the amount of blockage below the threshold value in each layer of the wellbore can be generated. In some aspects, generating a pumping schedule can occur as part of a simulation. The pumping schedule can include dynamic ordering for the layers or dynamically adjusting the type of fluid or pump rate of fluid based on simulated changes to the well or reservoir layers. The pumping schedule can be implemented by a pump to perform an efficient acidizing process of a well.

Although FIG. 5 depicts block 580 as occurring after determining that the amount of blockage in each layer is below the threshold value, block 580 can occur as part of a real-time process for increasing the permeability of a well. In some aspects, the pumping schedule may be generated, in substantially real time, in response to pumping fluid into the wellbore.

Figure 6:
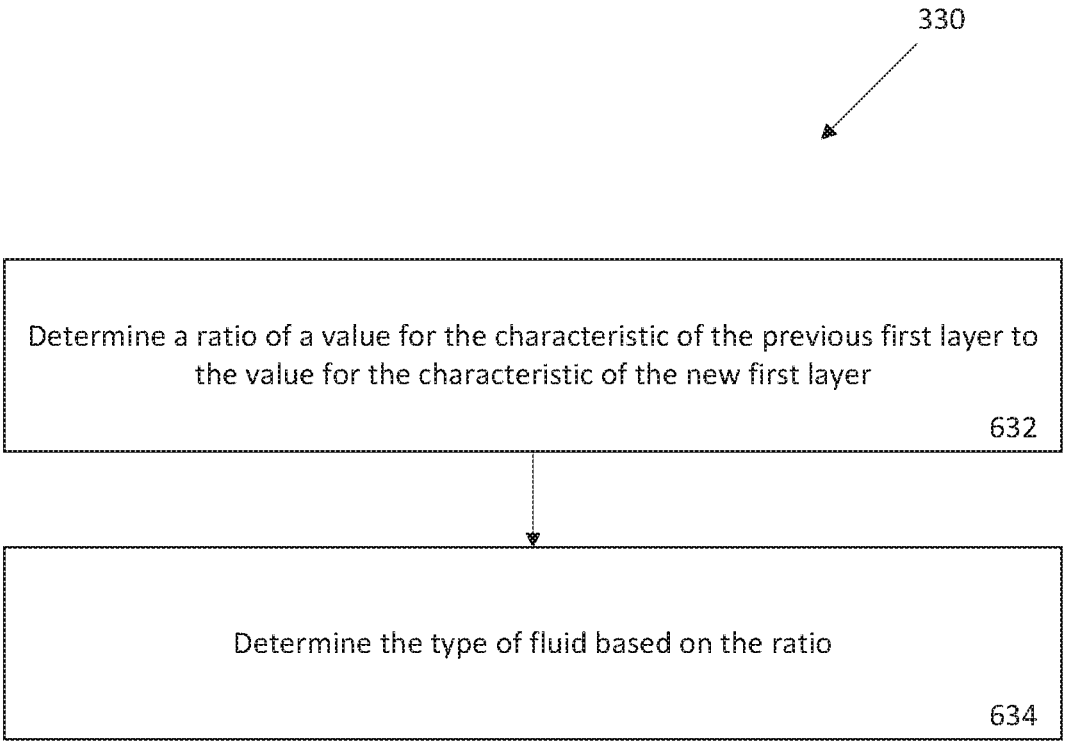
FIG. 6 is a flow chart of an example of a process for determining a pump rate and a type of fluid to pump into a wellbore according to one aspect of the present disclosure.

FIG. 6 is a flow chart of an example of the process in block 330 for determining a pump rate and a type of fluid to pump into a wellbore. In some aspects, the process can be performed after block 565 or block 575 of FIG. 5. At least one layer in the well can have a blockage that exceeds the threshold value and the process can determine if the type of fluid being pumped into the wellbore should be changed. In block 632, a ratio of the value for the characteristic of the previous first layer to the value for the characteristic of the new first layer can be determined. The previous first layer can be a layer removed from the ordered list of the layers based on the amount of blockage in the layer being below a threshold value. For example, a processing device can determine a ratio of a permeability of the first layer to a permeability of another layer in the ordered list. As another example, a processing device can determine a ratio of a leak-off rate (or a leak-off rate per unit height) of the first layer to a leak-off rate (or leak-off rate per unit height) of another layer in the ordered list. In some examples, the other layer can be the second layer in the ordered list of the layers. In some aspects, the previous first layer can have been removed from the ordered list of the layers in the previous step of the process. In additional or alternative aspects, the previous first layer can have been removed from the ordered list of the layers in one or more previous iterations.

In block 634, the type of fluid can be determined based on the ratio. In some examples, the processing device can determine that the ratio has exceeded a threshold ratio (e.g., a ratio of 2:1). Based on the ratio exceeding the threshold, the processing device can determine that a diverter fluid is to be pumped into the wellbore. The diverter can temporarily reduce the value for the characteristic of the first layer such that more of the subsequent fluid pumped into the wellbore will stimulate the other layers. The diverter can include polymeric agents or biodegradable agents (e.g., polylactic acid) that will reduce the value for the characteristic of a layer for a short period of time (e.g., a week). Based on the ratio being less than the threshold ratio, the processing device can determine that an acid is to be pumped into the wellbore. The threshold ratio can be user selected or predetermined based on features of the wellbore. In some aspects, the type of fluid can only be switched to be a diverter as part of the process of removing the first layer from the ordered list of the layers.

In some aspects, dynamically optimizing a pumping schedule for stimulating a well is provided according to one or more of the following examples:

Example #1

A method can include determining, by a processing device, that a particular layer of layers in a well has a highest value for a characteristic. The layers can be portions of a subterranean formation through which a wellbore is formed. The method can further include, based on determining that the particular layer has the highest value, assigning, by the processing device, the particular layer as a first layer in an ordered list of the layers. The method can further include determining, by the processing device and based on a feature of the first layer, a pump rate and a type of a fluid to pump into the wellbore for reducing an amount of a blockage in the first layer to below a threshold value. The blockage reducing a flow of a production fluid from the subterranean formation into the wellbore. The method can further include determining, by the processing device, changes to a value for the characteristic for each layer of the layers resulting from pumping the type of fluid into the wellbore at the pump rate. The method can further include determining, by the processing device, that another layer of the layers has the highest value for the characteristic as a result of pumping the fluid into the wellbore at the pump rate. The method can further include, based on determining that the other layer of the layers has the highest value for the characteristic, updating, by the processing device, the ordered list by assigning the other layer as the first layer in the ordered list of the layers.

Example #2

The method of Example #1, can feature the characteristic including a permeability, a leak-off rate, or a leak-off per unit height. The method can further include determining the ordered list by arranging the layers from the highest value for the characteristic to a lowest value for the characteristic.

Example #3

The method of Example #1, can feature determining changes to the value for the characteristic for each layer including calculating expected changes to the value for the characteristic for each layer based on simulating the type of fluid being pumped into the wellbore at the pump rate. The method can further include generating, based on the pump rate and the type of the fluid, a pumping schedule for reducing the amount of the blockage to below the threshold value for all layers.

Example #4

The method of Example #1, can further include determining that the amount of the blockage in the first layer is below the threshold value. The method can further include, based on determining that the amount of the blockage in the first layer is below the threshold value, updating the ordered list by removing a specific layer associated with the first layer from the ordered list.

Example #5

The method of Example #1, can further include causing a pump to inject the fluid of the type of fluid into the wellbore at the pump rate. The method can further include receiving, from sensors positioned in the wellbore, sensor data indicating the value for the characteristic of each layer. The method can further include determining the changes to the value for the characteristic of each based on the sensor data.

Example #6

The method of Example #1, can further include determining that the type of fluid is a diverter. Determining that the type of fluid is a diverter can include determining a ratio of the value for the characteristic of the first layer to the value for the characteristic of another layer. Determining that the type of fluid is a diverter can further include determining the ratio exceeds a threshold ratio. Determining that the type of fluid is a diverter can further include determining that the type of fluid is the diverter based on the ratio exceeding the threshold ratio.

Example #7

The method of Example #1, can further include determining that the type of fluid is an acid. Determining that the type of fluid is an acid can include determining a ratio of the value for the characteristic of the first layer to the value for the characteristic of another layer. Determining that the type of fluid is an acid can further include determining the ratio is below a threshold ratio. Determining that the type of fluid is an acid can further include determining that the type of fluid is the acid based on the ratio being below the threshold ratio.

Example #8

A non-transitory computer-readable medium can store instructions that can be executed by a processing device for causing the processing device to determine that a particular layer of layers in a well has a highest value for a characteristic. The layers can be portions of a subterranean formation through which a wellbore is formed. Based on determining that the particular layer of layers has the highest value, instructions can be executed by the processing device for causing the processing device to assign the particular layer as a first layer in an ordered list of the layers. Instructions can be executed by the processing device for causing the processing device to determine, based on a feature of the first layer, a pump rate and a type of a fluid to pump into the wellbore for reducing an amount of a blockage in the first layer to below a threshold value. The blockage can reduce a flow of a production fluid from the subterranean formation into the wellbore. Instructions can be executed by the processing device for causing the processing device to determine changes to a value for the characteristic for each layer of the layers resulting from pumping the type of fluid into the wellbore at the pump rate. Instructions can be executed by the processing device for causing the processing device to determine that another layer of the layers has the highest value for the characteristic as a result of pumping the fluid into the wellbore at the pump rate. Based on determining that the other layer of the layers has the highest value for the characteristic, instructions can be executed by the processing device for causing the processing device to update the ordered list by assigning the other layer as the first layer in the ordered list of the layers.

Example #9

The non-transitory computer-readable medium of Example #8, can feature the characteristic including a permeability, a leak-off rate, or a leak-off per unit height. The non-transitory computer-readable medium can further include additional instructions that can be executed by the processing device for causing the processing device to determine the ordered list by arranging the layers from the highest value for the characteristic to a lowest value for the value for the characteristic.

Example #10

The non-transitory computer-readable medium of Example #8, can feature the instructions executed by the processing device for causing the processing device to determine the value for the characteristic of each layer of the layers including calculating expected changes to the value for the characteristic of each layer of the layers based on simulating the type of fluid being pumped into the wellbore at the pump rate. Additional instructions that can be executed by the processing device can be stored on the non-transitory computer-readable medium for causing the processing device to generate, based on the pump rate and the type of the fluid, a pumping schedule for reducing the amount of the blockage to below the threshold value for all layers.

Example #11

The non-transitory computer-readable medium of Example #8, can further include additional instructions that can be executed by the processing device for causing the processing device to determine that the amount of the blockage in the first layer is below the threshold value. Based on determining that the amount of the blockage in the first layer is below the threshold value, additional instructions stored on the non-transitory computer-readable medium can be executed by the processing device for causing the processing device to update the ordered list of the layers by removing a specific layer associated with the first layer from the ordered list of the layers.

Example #12

The non-transitory computer-readable medium of Example #8, can further include additional instructions that can be executed by the processing device for causing the processing device to cause a pump to inject the type of fluid into the wellbore at the pump rate. The non-transitory computer-readable medium can further include additional instructions that can be executed by the processing device for causing the processing device to receive, from sensors positioned in the wellbore, sensor data indicating the value for the characteristic of each layer of the layers. The non-transitory computer-readable medium can further include additional instructions that can be executed by the processing device for causing the processing device to determine the changes to the value for the characteristic of each layer of the layers based on the sensor data.

Example #13

The non-transitory computer-readable medium of Example #8, can further include additional instructions that can be executed by the processing device for causing the processing device to determine a ratio of the value for the characteristic of the first layer to the value for the characteristic of another layer of the layers. The non-transitory computer-readable medium can further include additional instructions that can be executed by the processing device for causing the processing device to determine the ratio exceeds a threshold ratio. The non-transitory computer-readable medium can further include additional instructions that can be executed by the processing device for causing the processing device to determine that the type of fluid is a diverter based on the ratio exceeding the threshold ratio.

Example #14

The non-transitory computer-readable medium of Example #8, can further include additional instructions that can be executed by the processing device for causing the processing device to determine a ratio of the value for the characteristic of the first layer to the value for the characteristic of another layer of the layers. The non-transitory computer-readable medium can further include additional instructions that can be executed by the processing device for causing the processing device to determine the ratio is below a threshold ratio. The non-transitory computer-readable medium can further include additional instructions that can be executed by the processing device for causing the processing device to determine that the type of fluid is an acid based on the ratio being below the threshold ratio.

Example #15

A system can include a processing device and a memory device. The memory device can store instructions for causing the processing device to determine, that a particular layer of layers in a well has a highest value for a characteristic. The layers can be portions of a subterranean formation through which a wellbore is formed. Based on determining that the particular layer of the layers has the highest value, the memory device can further store instructions for causing the processing device to assign the particular layer as a first layer in an ordered list of the layers. The memory device can further store instructions for causing the processing device to determine, based on a feature of the first layer, a pump rate and a type of a fluid to pump into the wellbore for reducing an amount of a blockage in the first layer to below a threshold value. The blockage can reduce a flow of a production fluid from the subterranean formation into the wellbore. The memory device can further store instructions for causing the processing device to determine changes to a value for the characteristic for each layer of the layers resulting from pumping the type of fluid into the wellbore at the pump rate. The memory device can further store instructions for causing the processing device to determine that another layer of the layers has the highest value for the characteristic as a result of pumping the fluid into the wellbore at the pump rate. Based on determining that the other layer of the layers has the highest value for the characteristic, the memory device can further store instructions for causing the processing device to update the ordered list by assigning the other layer as the first layer in the ordered list of the layers.

Example #16

The system of Example #15, can feature the characteristic including a permeability, a leak-off rate, or a leak-off per unit height. The memory device can further include additional instructions for causing the processing device to determine the ordered list by arranging the layers from the highest value for the characteristic to a lowest value for the characteristic.

Example #17

The system of Example #15, can feature the instructions for causing the processing device to determine the changes to the value for the characteristic of each layer of the layers including calculating expected changes to the value for the characteristic of each layer of the layers based on simulating the type of fluid being pumped into the wellbore at the pump rate. The memory device can further include additional instructions for causing the processing device to generate, based on the pump rate and the type of the fluid, a pumping schedule for reducing the amount of the blockage to below the threshold value for all layers.

Example #18

The system of Example #15, can feature the memory device further including additional instructions for causing the processing device to determine that the amount of the blockage in the first layer is below the threshold value. Based on determining that the amount of the blockage in the first layer is below the threshold value, the memory device can further store instructions for causing the processing device to updating the ordered list of the layers by removing a specific layer associated with the first layer from the ordered list of the layers.

Example #19

The system of Example #15, can further include a pump communicatively coupled to the processing device for pumping the fluid of the of the type of fluid into the wellbore at the pump rate. The system can further include sensors positioned in the wellbore and communicatively coupled to the processing device for transmitting sensor data indicating the value for the characteristic of each layer of the layers to the processing device.

Example #20

The system of Example #15, can feature the memory device further including additional instructions for causing the processing device to determine a ratio of the value for the characteristic of the first layer to the value for the characteristic of another layer of the layers. The memory device can further store instructions for causing the processing device to determine that the type of fluid is a diverter if the ratio exceeds a threshold ratio or an acid if the ratio is below the threshold ratio.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method comprising:

determining, by a processing device, that a particular layer of a plurality of layers in a well has a highest value for a characteristic, the plurality of layers being portions of a subterranean formation through which a wellbore is formed;

based on determining that the particular layer of a plurality of layers has the highest value, assigning, by the processing device, the particular layer as a first layer in an ordered list of the plurality of layers;

determining, by the processing device and based on a feature of the first layer, a pump rate and a type of a fluid to pump into the wellbore for reducing an amount of a blockage in the first layer to below a threshold value, the blockage reducing a flow of a production fluid from the subterranean formation into the wellbore;

determining, by the processing device, changes to a value for the characteristic for each layer of the plurality of layers resulting from pumping the type of fluid into the wellbore at the pump rate;

determining, by the processing device, that another layer of the plurality of layers has the highest value for the characteristic as a result of pumping the fluid into the wellbore at the pump rate; and based on determining that the other layer of the plurality of layers has the highest value for the characteristic, updating, by the processing device, the ordered list by assigning the other layer as the first layer in the ordered list of the plurality of layers.

2. The method of claim 1, wherein the characteristic comprises a permeability, a leak-off rate, or a leak-off per unit height, and the method further comprises determining the ordered list by arranging the plurality of layers from the highest value for the characteristic to a lowest value for the characteristic.

3. The method of claim 1, wherein determining changes to the value for the characteristic for each layer of the plurality of layers comprises calculating expected changes to the value for the characteristic for each layer of the plurality of layers based on simulating the type of fluid being pumped into the wellbore at the pump rate, the method further comprising generating, based on the pump rate and the type of the fluid, a pumping schedule for reducing the amount of the blockage to below the threshold value for all layers in the plurality of layers.

4. The method of claim 1, further comprising:

determining that the amount of the blockage in the first layer is below the threshold value; and based on determining that the amount of the blockage in the first layer is below the threshold value, updating the ordered list by removing a specific layer associated with the first layer from the ordered list.

5. The method of claim 1, further comprising:

causing a pump to inject the fluid of the type of fluid into the wellbore at the pump rate;

receiving, from a plurality of sensors positioned in the wellbore, sensor data indicating the value for the characteristic of each layer of the plurality of layers; and determining the changes to the value for the characteristic of each layer of the plurality of layers based on the sensor data.

6. The method of claim 1, further comprising determining that the type of fluid is a diverter by:

determining a ratio of the value for the characteristic of the first layer to the value for the characteristic of another layer of the plurality of layers;

determining the ratio exceeds a threshold ratio; and determining that the type of fluid is the diverter based on the ratio exceeding the threshold ratio.

7. The method of claim 1, further comprising determining that the type of fluid is an acid by:

determining a ratio of the value for the characteristic of the first layer to the value for the characteristic of another layer of the plurality of layers;

determining the ratio is below a threshold ratio; and determining that the type of fluid is the acid based on the ratio being below the threshold ratio.

8. A non-transitory computer-readable medium in which instructions executable by a processing device are stored for causing the processing device to:

determine, that a particular layer of a plurality of layers in a well has a highest value for a characteristic, the plurality of layers being portions of a subterranean formation through which a wellbore is formed;

based on determining that the particular layer of a plurality of layers has the highest value, assign the particular layer as a first layer in an ordered list of the plurality of layers;

determine, based on a feature of the first layer, a pump rate and a type of a fluid to pump into the wellbore for reducing an amount of a blockage in the first layer to below a threshold value, the blockage reducing a flow of a production fluid from the subterranean formation into the wellbore;

determine changes to a value for the characteristic for each layer of the plurality of layers resulting from pumping the type of fluid into the wellbore at the pump rate;

determine that another layer of the plurality of layers has the highest value for the characteristic as a result of pumping the fluid into the wellbore at the pump rate; and based on determining that the other layer of the plurality of layers has the highest value for the characteristic, update the ordered list by assigning the other layer as the first layer in the ordered list of the plurality of layers.

9. The non-transitory computer-readable medium of claim 8, wherein the characteristic comprises a permeability, a leak-off rate, or a leak-off per unit height, the non-transitory computer-readable medium further comprising additional instructions executable by the processing device for causing the processing device to determine the ordered list by arranging the plurality of layers from the highest value for the characteristic to a lowest value for the value for the characteristic.

10. The non-transitory computer-readable medium of claim 8, wherein the instructions executable by the processing device for causing the processing device to determine the value for the characteristic of each layer of the plurality of layers comprises calculating expected changes to the value for the characteristic of each layer of the plurality of layers based on simulating the type of fluid being pumped into the wellbore at the pump rate, further comprising additional instructions executable by the processing device for causing the processing device to generate, based on the pump rate and the type of the fluid, a pumping schedule for reducing the amount of the blockage to below the threshold value for all layers in the plurality of layers.

11. The non-transitory computer-readable medium of claim 8, further comprising additional instructions executable by the processing device for causing the processing device to:

determine that the amount of the blockage in the first layer is below the threshold value; and based on determining that the amount of the blockage in the first layer is below the threshold value, update the ordered list of the layers by removing a specific layer associated with the first layer from the ordered list of the layers.

12. The non-transitory computer-readable medium of claim 8, further comprising additional instructions executable by the processing device for causing the processing device to:

cause a pump to inject the type of fluid into the wellbore at the pump rate;

receive, from a plurality of sensors positioned in the wellbore, sensor data indicating the value for the characteristic of each layer of the plurality of layers; and determine the changes to the value for the characteristic of each layer of the plurality of layers based on the sensor data.

13. The non-transitory computer-readable medium of claim 8, further comprising additional instructions executable by the processing device for causing the processing device to:

determine a ratio of the value for the characteristic of the first layer to the value for the characteristic of another layer of the plurality of layers;

determine the ratio exceeds a threshold ratio; and determine that the type of fluid is a diverter based on the ratio exceeding the threshold ratio.

14. The non-transitory computer-readable medium of claim 8, further comprising additional instructions executable by the processing device for causing the processing device to:

determine a ratio of the value for the characteristic of the first layer to the value for the characteristic of another layer of the layers;

determine the ratio is below a threshold ratio; and determine that the type of fluid is an acid based on the ratio being below the threshold ratio.

15. A system comprising:

a processing device; and a memory device on which instructions are stored for causing the processing device to:

determine, that a particular layer of a plurality of layers in a well has a highest value for a characteristic, the plurality of layers being portions of a subterranean formation through which a wellbore is formed;

based on determining that the particular layer of the plurality of layers has the highest value, assign the particular layer as a first layer in an ordered list of the plurality of layers;

determine, based on a feature of the first layer, a pump rate and a type of a fluid to pump into the wellbore for reducing an amount of a blockage in the first layer to below a threshold value, the blockage reducing a flow of a production fluid from the subterranean formation into the wellbore;

determine changes to a value for the characteristic for each layer of the plurality of layers resulting from pumping the type of fluid into the wellbore at the pump rate;

determine that another layer of the plurality of layers has the highest value for the characteristic as a result of pumping the fluid into the wellbore at the pump rate; and based on determining that the other layer of the plurality of layers has the highest value for the characteristic, update the ordered list by assigning the other layer as the first layer in the ordered list of the plurality of layers.

16. The system of claim 15, wherein the characteristic comprises a permeability, a leak-off rate, or a leak-off per unit height, the memory device further comprises additional instructions for causing the processing device to determine the ordered list by arranging the plurality of layers from the highest value for the characteristic to a lowest value for the characteristic.

17. The system of claim 15, wherein the instructions for causing the processing device to determine the changes to the value for the characteristic of each layer of the plurality of layers comprises calculating expected changes to the value for the characteristic of each layer of the plurality of layers based on simulating the type of fluid being pumped into the wellbore at the pump rate, the memory device further comprising additional instructions for causing the processing device to generate, based on the pump rate and the type of the fluid, a pumping schedule for reducing the amount of the blockage to below the threshold value for all layers in the plurality of layers.

18. The system of claim 15, wherein the memory device further comprises additional instructions for causing the processing device to:

determine that the amount of the blockage in the first layer is below the threshold value; and based on determining that the amount of the blockage in the first layer is below the threshold value, updating the ordered list of the layers by removing a specific layer associated with the first layer from the ordered list of the layers.

19. The system of claim 15, further comprising:

a pump communicatively coupled to the processing device for pumping the fluid of the of the type of fluid into the wellbore at the pump rate; and a plurality of sensors positionable in the wellbore and communicatively coupleable to the processing device for transmitting sensor data indicating the value for the characteristic of each layer of the plurality of layers to the processing device.

20. The system of claim 15, wherein the memory device further comprises additional instructions for causing the processing device to:

determine a ratio of the value for the characteristic of the first layer to the value for the characteristic of another layer of the plurality of layers;

determine that the type of fluid is a diverter if the ratio exceeds a threshold ratio or an acid if the ratio is below the threshold ratio.

* * * * *